US005888449A

United States Patent [19]

Kennedy et al.

[11] Patent Number: 5,888,449

[45] Date of Patent: Mar. 30, 1999

[54] STAINLESS STEEL

[75] Inventors: Richard L. Kennedy, Monroe; Wei-Di Cao, Charlotte, both of N.C.

[73] Assignee: Teledyne Industries, Inc., Pittsburgh, Pa.

[21] Appl. No.: 866,547

[22] Filed: May 30, 1997

[51] Int. Cl.[6] ..... C22C 38/44

[52] U.S. Cl. ..... 420/52; 420/63; 148/326; 148/327; 148/325

[58] Field of Search ..... 420/52, 63; 148/326, 148/327, 325

[56] References Cited

U.S. PATENT DOCUMENTS 3,556,776 1/1971 Clark, Jr. et al. .

4,814,141 3/1989 Imai et al. .

*Primary Examiner*—Deborah Yee

*Attorney, Agent, or Firm*—Alston & Bird LLP

[57] ABSTRACT

Precipitation hardening (PH) stainless steels heat treatable to yield strength levels in the range of 200 ksi with exceptionally high fracture toughness are achieved in alloys consisting essentially of 12.25–13.25% chromium, 7.5–8.5% nickel, 2.0–2.5% molybdenum, 0.8–1.35% aluminum, not over 0.05% carbon, not over 0.10% silicon, not over 0.10% manganese, not over 0.010% phosphorus and with especially critical amounts of not over 0.0020% (20 ppm) nitrogen, not over 0.0020% (20 ppm) sulfur, not over 0.0026% (26 ppm) nitrogen plus sulfur; not over 0.04% titanium, and remainder essentially Fe.

12 Claims, 6 Drawing Sheets

Effect of S+$N_2$ Content & Al Content on Fracture Toughness of 13Cr-8Ni-2Mo Precipitation Hardening Steel

Figure 2 - Effect of N Levels on Fracture Toughness of Precipitation Hardening 13Cr-8Ni-2Mo Steel at Different S Levels
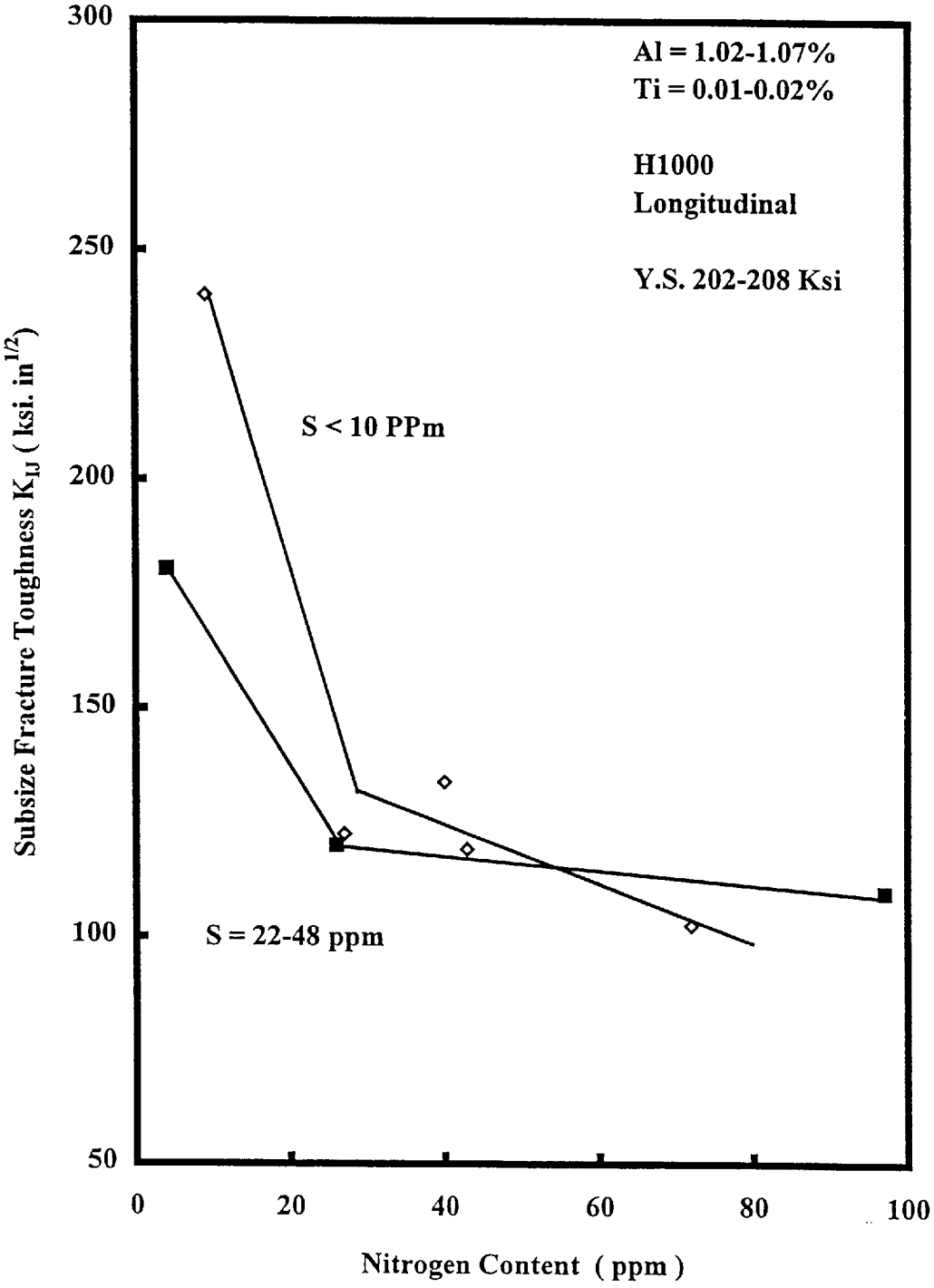

Figure 3 - Effect of Nitrogen Content on Transverse Charpy Impact Energy of Precipitation Hardening 13Cr-8Ni-2Mo Steel at -22°F
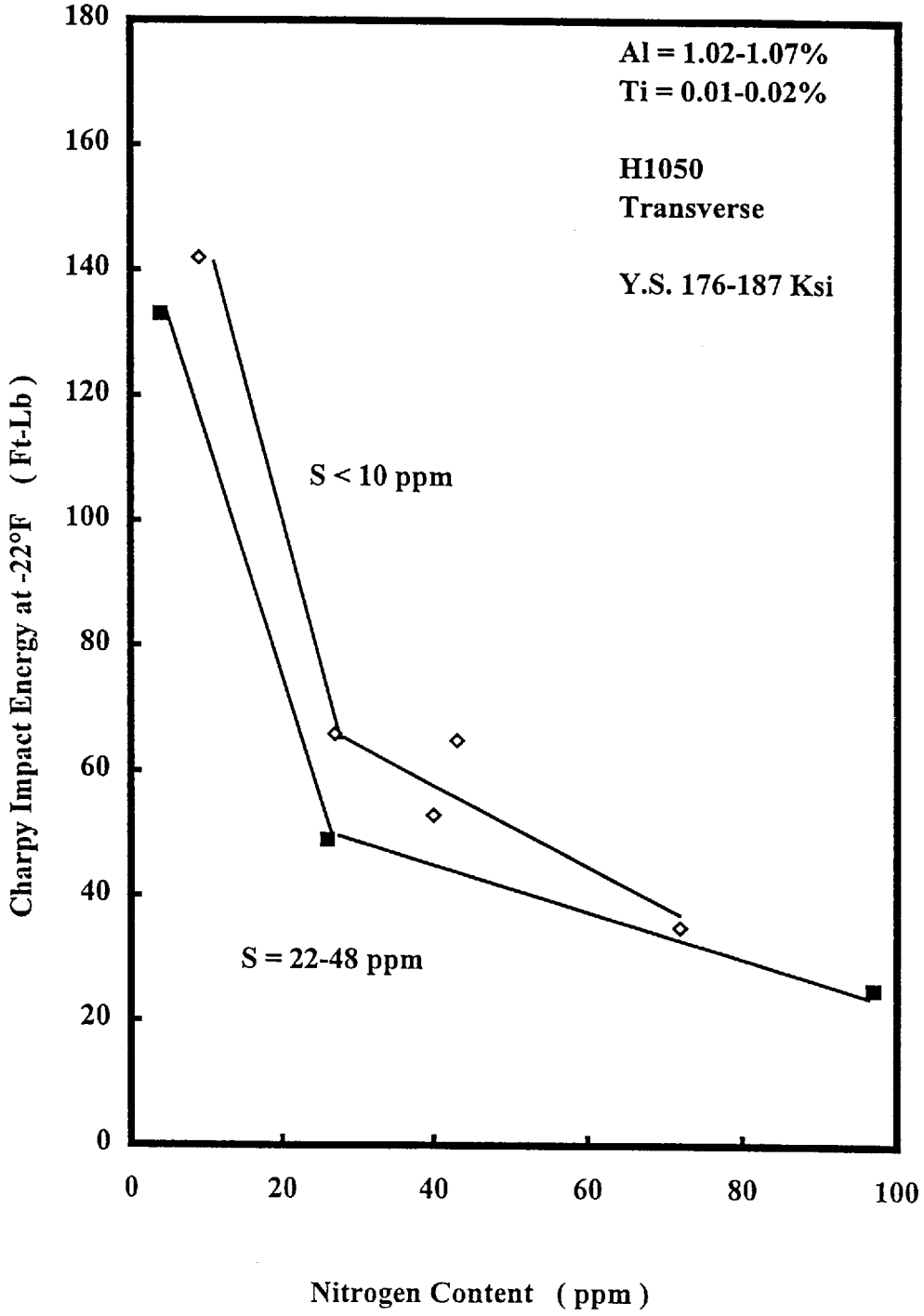

Figure 4 - Effect of $S+N_2$ Content & Al Content on Fracture Toughness of 13Cr-8Ni-2Mo Precipitation Hardening Steel
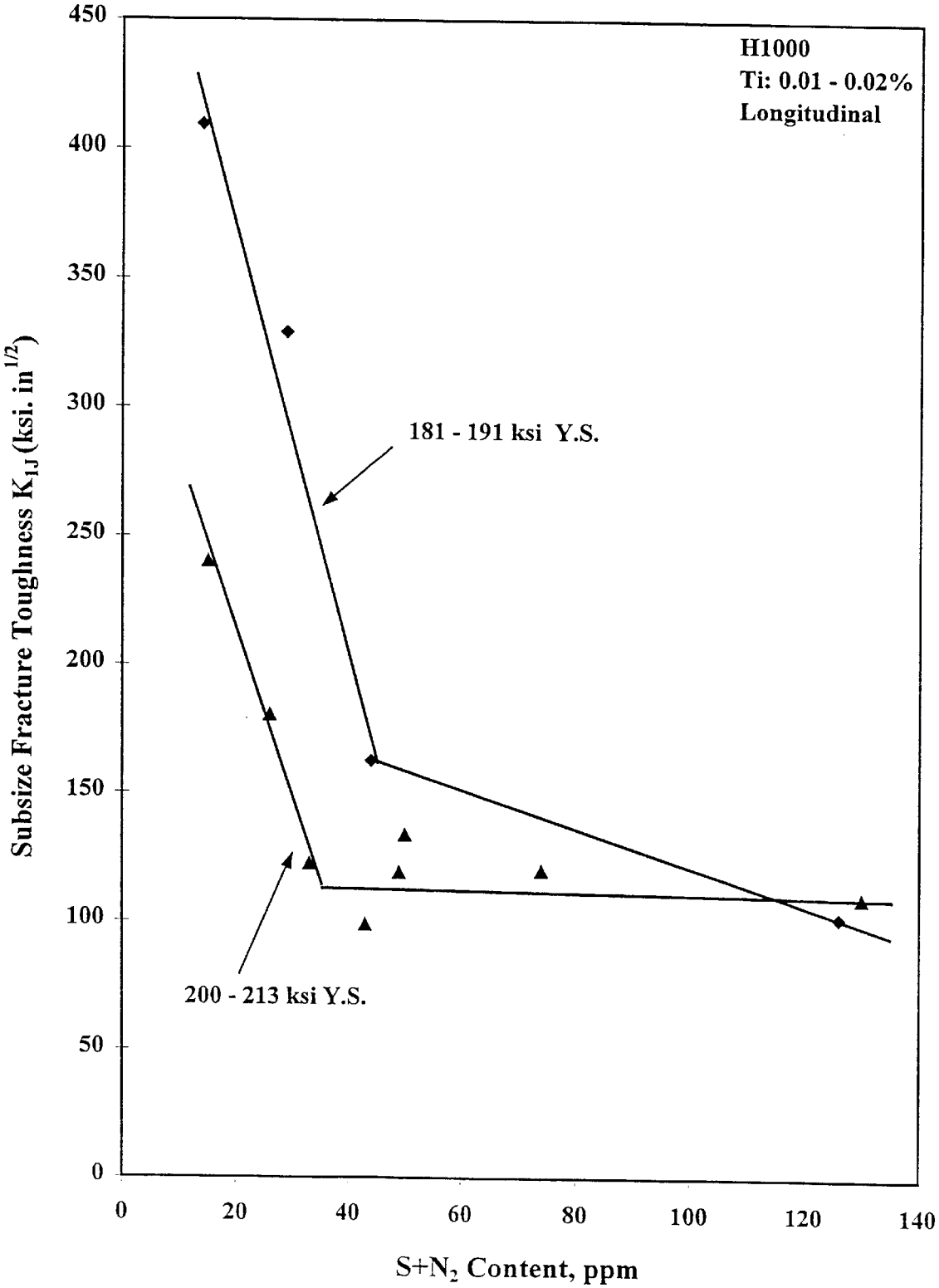

Figure 5 - Subsize Fracture Toughness as a Function of Ti Content of Precipitation Hardening 13Cr-8Ni-2Mo Steel at Different Impurity Levels
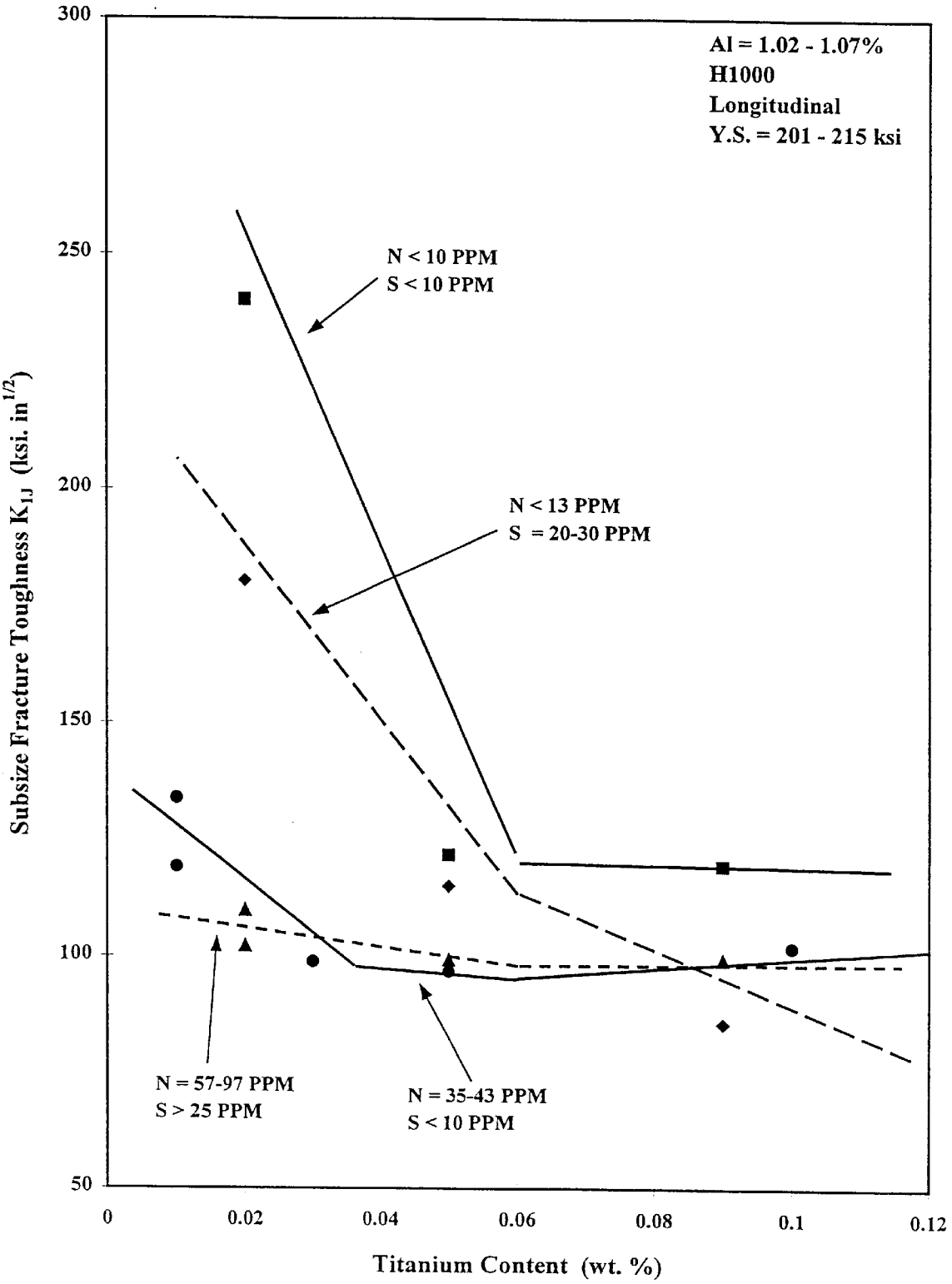

Figure 6 - Effect of Ti Content on Charpy Impact Energy of Precipation Hardening 13Cr-8Ni-2Mo Steel at -22°F
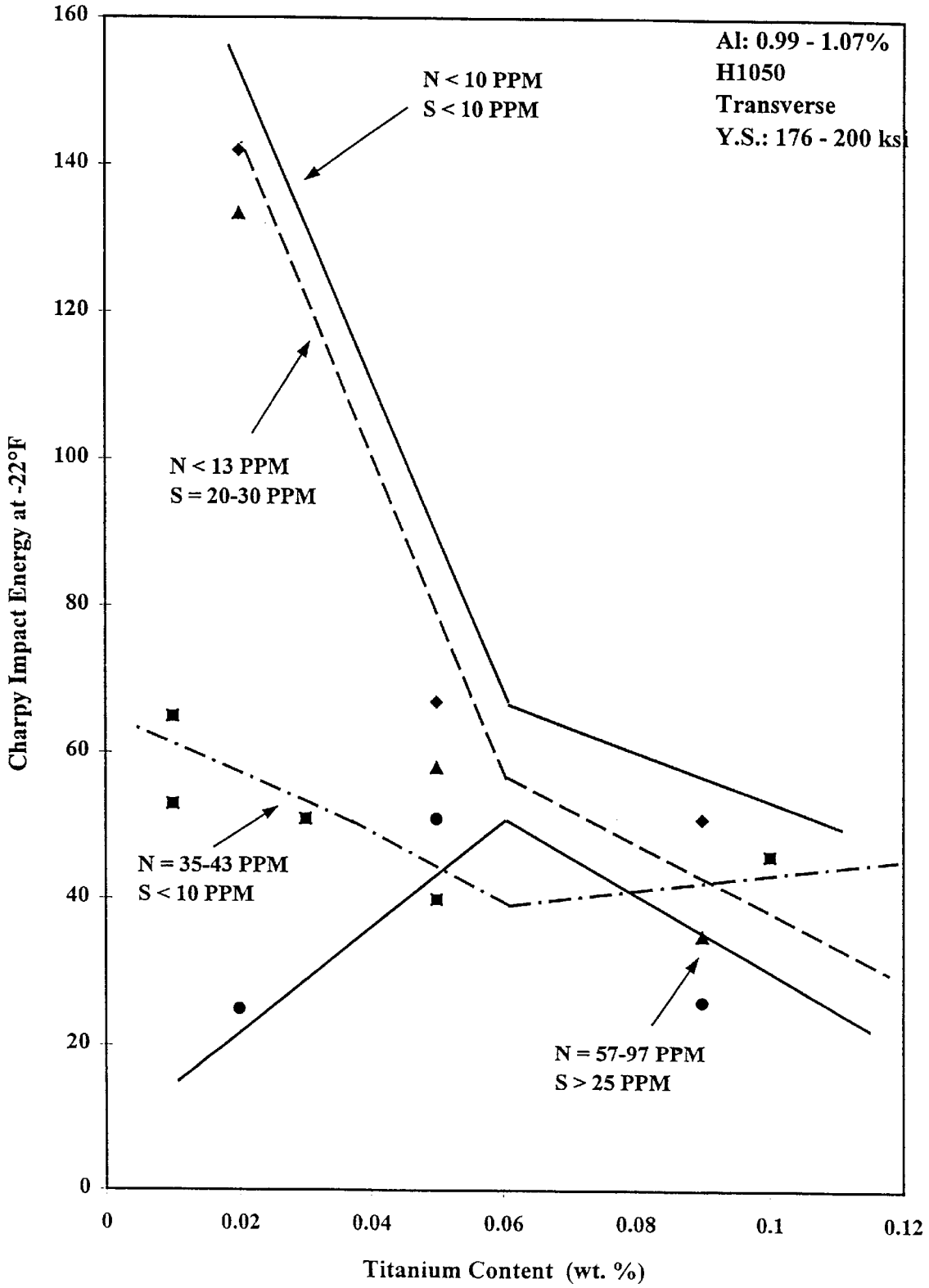

STAINLESS STEEL

BACKGROUND OF THE INVENTION

The present invention relates to stainless steels and in particular to 13-8Mo steels having significantly improved fracture toughness ($K_{IC}$) over conventional 13-8Mo steels.

It is well known to those skilled in the art that fracture toughness is a measure of a material's resistance to crack propagation and catastrophic failure and is an important characteristic in the design of certain critical components. Generally for metallic alloys, toughness is inversely related to strength, i.e. the higher the strength, the lower the toughness. Within this general relationship, individual alloys and families of alloys display distinctive relationships between strength and toughness. These characteristics can be clearly seen in FIG. 1. Precipitation hardening (PH) stainless steels, as a group, tend to be found in the less desirable, low strength, low toughness portion of this figure.

It is generally well known that small amounts of certain elements or impurities, including metallics, metalloids or non-metallics, can dramatically alter the properties of all alloys. The specific elements or impurities and the amounts which result in harmful effects vary widely, depending upon the alloy, the condition and the properties of interest. For example, in 13-8Mo steels as described in U.S. Pat. No. 3,556,776 to Clarke et al. which is hereby incorporated in its entirety by reference, critically low levels of manganese, silicon, phosphorus, sulfur and nitrogen resulted in good ductility in combination with great strength.

SUMMARY OF THE INVENTION

In this invention we have discovered that with precipitation hardening stainless steels of the type known commercially as 13-8Mo, the toughness can be raised to exceptionally high values if the nitrogen and sulfur content is controlled to very low levels. Additionally, it is preferred that the titanium content be controlled to within a desired range. In particular, we have discovered that exceptionally high values of toughness are achieved if the sulfur does not exceed 0.0025% (25 ppm), nitrogen does not exceed 0.0020% (20 ppm) and titanium, if present, is less than 0.05% and preferably does not exceed 0.04%. Furthermore, the combined amount of sulfur plus nitrogen should not exceed 0.0030% (30 ppm).

We have further discovered that at or below these critical limits of $N_2$, S and Ti, the rate of improvement with decreasing amounts of these elements is significantly increased over that which would occur at higher concentrations that are more typical of levels seen in commercial practice. This effect is clearly shown by the change in slope of curves 2 through 6.

The precipitation hardening stainless steels to which the present invention applies may be described as consisting essentially of about 12.25% to 13.25% chromium, about 7.5% to 8.5% nickel, about 2.0% to 2.5% molybdenum, about 0.8% to 1.35% aluminum, not exceeding 0.05% carbon, not exceeding 0.10% silicon, not exceeding 0.10% manganese, not exceeding 0.10% phosphorus, not exceeding 0.0025% sulfur, not exceeding 0.0020% nitrogen, and remainder essentially iron, and wherein the combined amount of sulfur plus nitrogen does not exceed 0.0030%. Preferably, titanium, if present, is less than 0.050%, and more preferably does not exceed 0.04%. In a more specific aspect, the combined sulfur plus nitrogen content should not exceed 0.0020% (20 ppm) and Ti should not exceed 0.02%.

Steels of this invention show fracture toughnesses at yield strength levels of up to about 200 ksi of greater than 200 ksi-in$^{1/2}$, which far exceeds those of a wide variety of contemporary, commercial high strength steels, as well as the PH steels, as shown in FIG. 1.

The levels of impurity elements required to achieve the noted improvements are significantly lower than those obtained in normal commercial practice for alloys of this type and can only be achieved with careful selection of raw materials with low nitrogen content and special melting practices such as vacuum induction melting and vacuum arc remelting.

Thus, in a further aspect, the present invention provides a method for improving the fracture toughness of stainless steels of the type which have an iron base with 12.25% to 13.25% chromium, 7.5% to 8.5% nickel, 2.0% to 2.5% molybdenum, and 0.8% to 1.35% aluminum. The method comprises melting selected raw materials under controlled conditions to achieve in the stainless steel a sulfur content not exceeding 0.0025%, a nitrogen content not exceeding 0.0020%, a titanium content of less than 0.05%, and a combined amount of sulfur plus nitrogen not exceeding 0.0030%.

The present invention further provides a method for producing a stainless steel article of high fracture toughness, wherein a stainless steel is produced which consists essentially of an iron base with 12.25% to 13.25% chromium, 7.5% to 8.5% nickel, 2.0% to 2.5% molybdenum, 0.8% to 1.35% aluminum, not exceeding 0.05% carbon, not exceeding 0.10% silicon, not exceeding 0.10% manganese, not exceeding 0.10% phosphorus, not exceeding 0.0025% sulfur, not exceeding 0.0020% nitrogen, and not exceeding 0.04% titanium; and the stainless steel is heat treated to produce a precipitation hardened stainless steel article having a fracture toughness at yield strength levels below 200 ksi of greater than 200 ksi-in$^{1/2}$. Standard industry heat treatment processes are employed.

BRIEF DESCRIPTION OF THE DRAWINGS

Some of the features and advantages of the invention having been stated, others will become apparent from the detailed description which follows, and from the accompanying drawings, in which:

FIG. 2 is a graph showing the effect of nitrogen content on fracture toughness of precipitation hardening 13Cr-8Ni-2Mo precipitation hardening steel at different sulfur levels;

FIG. 3 is a graph showing the effect of nitrogen content on Charpy impact energy of precipitation hardening 13Cr-8Ni-2Mo steel at −22° F. for different sulfur levels;

FIG. 4 is a graph showing the effect of combined nitrogen and sulfur content on fracture toughness of 13Cr-8Ni-2Mo steel;

FIG. 5 is a graph showing the effect of titanium content on subsize fracture toughness of 13Cr-8Ni-2Mo steel at different impurity levels of nitrogen and sulfur; and FIG. 6 is a graph showing the effect of titanium content on Charpy impact energy of 13Cr-8Ni-2Mo steel at −22° F. at different impurity levels of nitrogen and sulfur.

DESCRIPTION OF PREFERRED EMBODIMENTS

Figure 1:
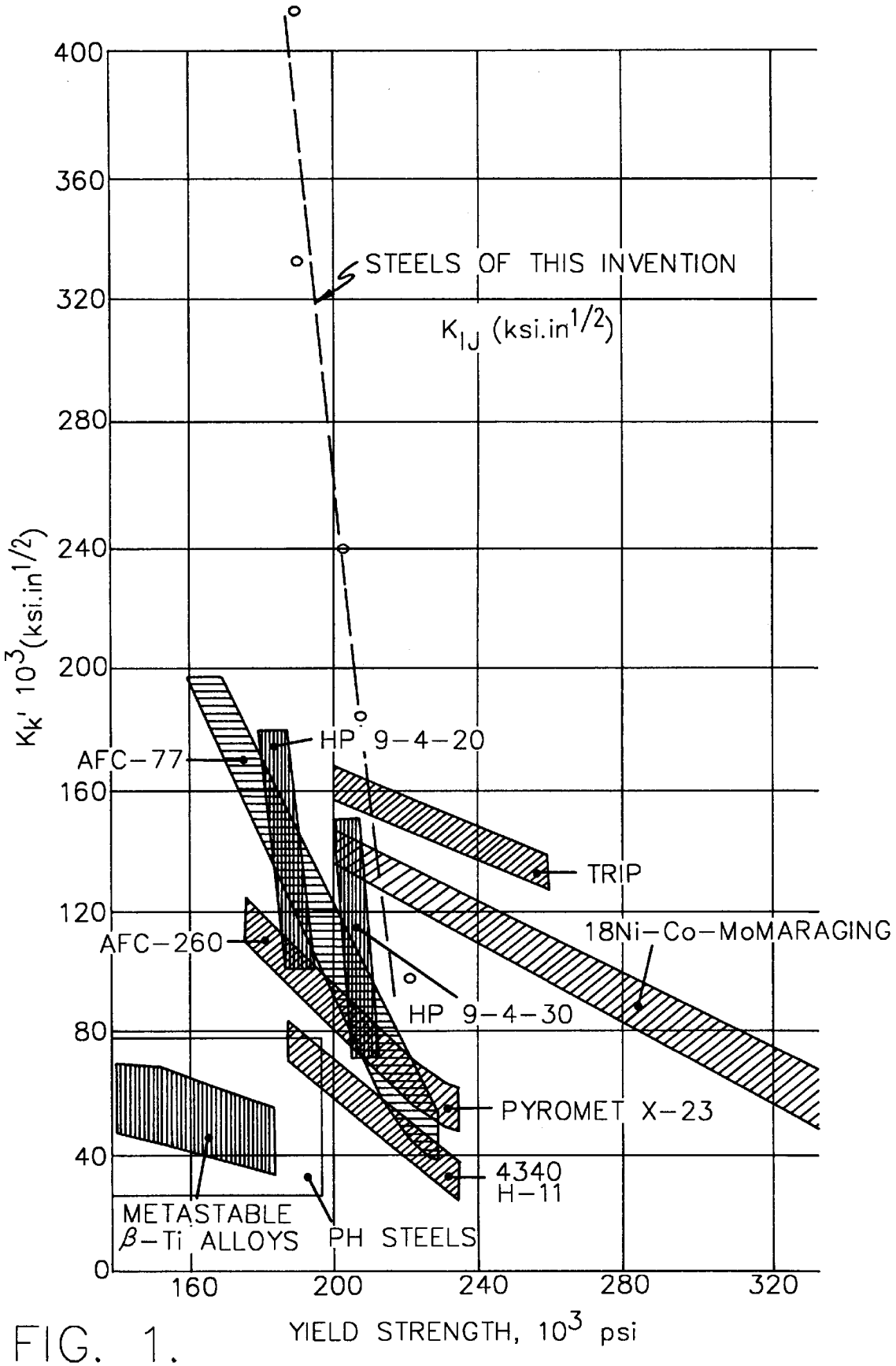
FIG. 1 is a graph showing the fracture toughness of various steels as a function of yield strength.

To determine the effects of certain elements on fracture toughness, a number of experimental heats were made. The only variables were aluminum, titanium, sulfur and nitrogen. All other elements were held constant and were well within normal analytical variation (Table 1). All heats weighed 150 lbs and were produced by vacuum induction melting followed by vacuum arc remelting to 5.5 inch diameter ingots. Ingots were forged to three inch square from 2000° F., then subsequently rolled to 1"×3.5" flat bar from 1800° F. Test samples were cut from this bar in both longitudinal and transverse orientations and heat treated to the industry standard conditions, i.e. 1700° F. solution plus 1000° F. (H1000) or 1050° F. (H1050) age. Standard ASTM E23 impact specimens were machined and tested. Because of the extremely high toughness of this material, subsize fracture toughness testing based on J-integral concept was performed, as described in ASTM STP514, P.1-39, 1972, leading to toughness value $K_{JI}$ which is equivalent to $K_{IC}$ Fracture toughness and impact results for steels prepared for this study are presented in Tables 2 and 3, respectively, along with the varying chemical elements (Al, Ti, S and $N_2$) and corresponding tensile properties. Because toughness varies so dramatically with yield strength, it is necessary to examine the effects of any given variable at a constant strength level which equates to a reasonably narrow aluminum content and a constant aging temperature. Thus the effect of nitrogen and sulfur contents on fracture toughness is presented in FIG. 2 for steels with 1.02–1.07% Al and yield strengths of 202–208 ksi.

From this figure it is apparent that $N_2$ does not exert a significant influence on fracture toughness at levels of about 30 to 100 ppm which corresponds to the range most often seen in commercial practice and which is reasonably consistent with U.S. Pat. No. 3,556,776. However, at $N_2$ levels of less than about 26 ppm, a dramatic, upward change in the slope of the fracture toughness vs. nitrogen content curve occurs and toughness doubles at 9 ppm nitrogen for the lowest sulfur content materials (<10 ppm S). Although the same general trend occurs for higher sulfur content materials, the level of toughness improvement at the lowest nitrogen contents is depressed somewhat or conversely the improvement in toughness with decreasing $N_2$ for steels of the present invention is greatest at the lowest possible sulfur contents. Almost identical results were observed for transverse Charpy Impact Toughness values measured at −22° F., as seen in FIG. 3.

The combined effect of $N_2$+S on toughness for steels of varying strength levels is shown in FIG. 4. From this figure it is also apparent there is a very abrupt change in the response of toughness to the combined effects of $N_2$+S. Between 30 or 40 ppm and 130 ppm $N_2$+S, there is little effect on toughness. Below this level, however, the slope of the curves again increase dramatically with toughness, more than doubling at the lowest $N_2$+S contents for steels of both strength ranges shown. The critical $N_2$+S contents for this abrupt change in toughness occur at a lower level for steels of the higher yield strengths.

Titanium is frequently added to steels of this type, as described in U.S. Pat. No. 3,556,776, at levels of 0.05 to 0.50%. Like $N_2$, it has been discovered in accordance with the present invention that restricting Ti to levels much lower than normally employed is essential to achieving significantly improved toughness. The dramatic toughness improvements noted above for ultra low $N_2$+S levels can only be obtained with levels of Ti substantially less than 0.05%. This is seen clearly from FIGS. 5 and 6. With Ti levels of 0.05% to 0.10%, there is almost no change in toughness. Below 0.05% Ti, the slope of both fracture toughness and Charpy Impact curves increase dramatically, nearly doubling at 0.02% Ti, but only for the low $N_2$ heats. For the higher $N_2$ and higher S heats, there is no consistent effect of Ti content within the range investigated. For purposes of the present invention, the titanium content should be less than 0.05% and preferably should not exceed 0.04%, and most desirably should not exceed 0.02%.

Fracture toughness of steels that comprise this invention is plotted as a function of yield strength in FIG. 1. While the curve appears to be quite steep, similar to other commercial steels HP 9-4-20 and HP 9-4-30, toughnesses at levels of below about 200 ksi Y.S. are outstanding (>260 ksi-in$^{1/2}$) and are significantly higher than other commercial high strength alloys, especially other PH steels.

Those skilled in the art will recognize that the steel of the present invention can be employed in all of the applications where conventional precipitation hardening 13-8Mo steel has been employed, and its dramatically enhanced toughness opens the possibility for uses in additional applications where high toughness is important. It will also be understood that all references herein to percentages and to parts per million (ppm) are calculated on a weight/weight basis.

The present invention is not limited to the specific examples given above, which are intended to be illustrative of the present invention but not restrictive.

TABLE 1

Chemistry of Test Steels

| Test | Chemistry (wt. %) | | | | | | | | | PPM | |
|---|---|---|---|---|---|---|---|---|---|---|---|
| Steel | C | Si | Mn | Cr | Ni | Mo | Ti | Al | P | S | N |
| G999-1 | .035 | 0.04 | 0.01 | 12.44 | 8.26 | 2.19 | 0.02 | 0.77 | <.003 | 22 | 7 |
| WA06-1 | .035 | 0.01 | 0.01 | 12.58 | 8.39 | 2.20 | 0.02 | 0.77 | <.003 | 5 | 9 |
| WB-18 | .036 | 0.01 | 0.01 | 12.38 | 8.25 | 2.20 | 0.03 | 0.81 | <.003 | 6 | 38 |
| WA01-1 | .033 | 0.01 | 0.01 | 12.51 | 8.31 | 2.22 | 0.02 | 1.06 | <.003 | 22 | 4 |
| WD13 | .037 | 0.01 | 0.01 | 12.46 | 8.34 | 2.24 | 0.01 | 1.04 | .003 | 48 | 26 |
| WA02 | .033 | 0.01 | 0.01 | 12.49 | 8.31 | 2.22 | 0.05 | 1.07 | <.003 | 20 | 13 |
| WA01-2 | .033 | 0.01 | 0.01 | 12.51 | 8.36 | 2.22 | 0.09 | 1.06 | <.003 | 22 | 10 |
| WA09-1 | .034 | 0.01 | 0.01 | 12.52 | 8.34 | 2.21 | 0.02 | 1.06 | <.003 | 33 | 97 |
| WA10 | .034 | 0.01 | 0.01 | 12.51 | 8.28 | 2.20 | 0.05 | 1.05 | <.003 | 31 | 57 |
| WA09-2 | .034 | 0.01 | 0.01 | 12.49 | 8.31 | 2.21 | 0.09 | 1.06 | <.003 | 32 | 82 |
| WA06-2 | .034 | 0.01 | 0.01 | 12.47 | 8.31 | 2.20 | 0.02 | 1.03 | <.003 | 6 | 9 |
| WD15 | .035 | 0.01 | 0.01 | 12.51 | 8.32 | 2.22 | 0.05 | 1.06 | .003 | 6 | 7 |
| WD16 | .036 | 0.01 | 0.01 | 12.49 | 8.30 | 2.21 | 0.09 | 1.02 | .003 | 7 | 9 |
| WD17 | .034 | 0.01 | 0.01 | 12.54 | 8.38 | 2.24 | 0.01 | 1.03 | .003 | 6 | 27 |
| WD14 | .035 | 0.01 | 0.01 | 12.49 | 8.30 | 2.23 | 0.01 | 1.07 | .003 | 10 | 40 |

TABLE 1-continued

Chemistry of Test Steels

| Test | Chemistry (wt. %) | | | | | | | | | PPM | |
|---|---|---|---|---|---|---|---|---|---|---|---|
| Steel | C | Si | Mn | Cr | Ni | Mo | Ti | Al | P | S | N |
| WD19 | .034 | 0.01 | 0.01 | 12.57 | 8.29 | 2.22 | 0.01 | 1.05 | <.003 | 6 | 72 |
| WD22-1 | .032 | 0.01 | 0.01 | 12.56 | 8.31 | 2.22 | 0.01 | 1.02 | <.003 | 6 | 43 |
| WB-19 | .036 | 0.01 | 0.01 | 12.35 | 8.27 | 2.21 | 0.03 | 1.04 | <.003 | 6 | 37 |
| WD18 | .034 | 0.01 | 0.01 | 12.56 | 8.31 | 2.23 | 0.05 | 0.99 | .033 | 6 | 35 |
| WA07-2 | .035 | 0.01 | 0.01 | 12.45 | 8.33 | 2.20 | 0.10 | 1.04 | <.003 | 6 | 41 |
| WD20 | .034 | 0.01 | 0.01 | 12.64 | 8.44 | 2.24 | 0.01 | 1.31 | .003 | 5 | 8 |
| AMS | .05 | .10 | .10 | 12.25/ | 7.5/ | 2.00/ | / | 0.90/ | 0.01 | 80 | 100 |
| 5629 | max | max | max | 13.25 | 8.5 | 2.50 | | 1.35 | max | max | max |

TABLE 2

Tensile Properties and Toughness of 13Cr—8Ni—2Mo Steels
(1" Thick Flat Bar Heat Treated 1700° F. × 1 Hr, AC to <300° F., IWQ + 1050° F. × 4 Hrs, AC to <100° F., IWQ for 30 min.)

| | Chemistry | | | | Tensile | | | | $K_{IC}$ (Ksi-in$^{1/2}$) | |
|---|---|---|---|---|---|---|---|---|---|---|
| | | | S | $N_2$ | 0.2% YS | UTS | | | | |
| Heat No. | Al % | Ti % | ppm | ppm | Ksi | Ksi | % El | % RA | Longitudinal | Transverse |
| Steels of this invention: | | | | | | | | | | |
| WA06-2 | 1.03 | 0.02 | 6 | 9 | 203.0 | 212.2 | 16.9 | 68.2 | 242.0 | 221.7 |
| | | | | | 201.7 | 212.7 | 16.8 | 67.3 | 238.6 | 220.5 |
| WA01-1 | 1.06 | 0.02 | 22 | 4 | 204.3 | 213.6 | 17.3 | 69.5 | — | 178.6 |
| | | | | | 204.6 | 213.4 | 16.8 | 69.1 | 180.5 | 180.9 |
| G999-1 | 0.77 | 0.02 | 22 | 7 | 182.4 | 192.3 | 15.5 | 61.8 | 330.0 | 299.7 |
| | | | | | 189.4 | 196.7 | 16.7 | 62.1 | 327.8 | 327.2 |
| WA06-1 | 0.77 | 0.02 | 5 | 9 | 186.7 | 196.9 | 18.9 | 73.4 | 416.6 | 361.0 |
| | | | | | 184.9 | 193.2 | 17.9 | 73.8 | 402.2 | 379.8 |
| WD20 | 1.31 | 0.01 | 5 | 8 | 221.1 | 228.8 | 13.7 | 61.6 | 94.5 | 91.2 |
| | | | | | 220.5 | 227.6 | 13.3 | 61.6 | 95.7 | 84.8 |
| Steels not of this invention: | | | | | | | | | | |
| WD13 | 1.04 | 0.01 | 48 | 26 | 206.1 | 212.0 | 14.1 | 60.9 | 118.6 | 114.9 |
| | | | | | 208.4 | 214.8 | 13.6 | 62.5 | 121.3 | 111.1 |
| WD17 | 1.03 | 0.01 | 6 | 27 | 205.5 | 210.9 | 14.4 | 66.2 | 123.1 | 117.4 |
| | | | | | 207.5 | 212.3 | 13.5 | 64.5 | 121.9 | 122.6 |
| WD22-1 | 1.02 | 0.01 | 6 | 43 | 208.3 | 213.1 | 14.0 | 65.9 | 118.5 | 124.9 |
| | | | | | 202.1 | 206.6 | 14.6 | 67.3 | 119.8 | 123.6 |
| WD14 | 1.07 | 0.01 | 10 | 40 | 207.8 | 214.3 | 13.8 | 64.0 | 138.1 | 126.9 |
| | | | | | 203.3 | 207.5 | 13.3 | 65.4 | 129.7 | 125.6 |
| WD19 | 1.05 | 0.01 | 6 | 72 | 211.9 | 217.5 | 14.0 | 62.5 | 105.5 | 96.1 |
| | | | | | 204.9 | 210.2 | 13.2 | 63.0 | 99.0 | 102.2 |
| WA09-1 | 1.06 | 0.02 | 33 | 97 | 202.3 | 213.1 | 15.1 | 58.2 | 120.0 | 65.1 |
| | | | | | 199.5 | 210.3 | 14.9 | 56.6 | 99.5 | 71.0 |
| WB18 | 0.81 | 0.02 | 6 | 38 | 187.7 | 195.8 | 17.8 | 73.0 | 133.5 | 115.4 |
| | | | | | 191.2 | 199.5 | 18.6 | 71.7 | 192.2 | 126.6 |
| WD08-1 | 0.81 | 0.02 | 38 | 88 | 188.3 | 197.1 | 17.9 | 73.6 | 101.7 | 78.5 |
| | | | | | 186.8 | 195.1 | 18.5 | 73.0 | 102.7 | 76.5 |
| WB19 | 1.04 | 0.03 | 6 | 37 | 204.1 | 213.6 | 17.0 | 67.7 | 95.7 | 100.1 |
| | | | | | 203.3 | 212.8 | 16.5 | 69.3 | 102.0 | 82.8 |
| WD15 | 1.06 | 0.05 | 6 | 7 | 211.5 | 217.7 | 17.1 | 71.7 | 122.0 | 111.7 |
| | | | | | 215.2 | 220.9 | 16.3 | 71.9 | 121.8 | 113.1 |
| WD16 | 1.02 | 0.09 | 7 | 9 | 212.6 | 219.8 | 15.1 | 70.4 | 121.4 | 111.9 |
| | | | | | 210.6 | 217.9 | 14.5 | 72.3 | 117.5 | 112.8 |
| WA02 | 1.07 | 0.05 | 20 | 13 | 210.9 | 220.9 | 16.4 | 69.6 | 119.7 | 93.4 |
| | | | | | 212.5 | 222.2 | 16.8 | 70.8 | 110.5 | 104.2 |
| WA10 | 1.05 | 0.05 | 31 | 57 | 203.6 | 214.5 | 17.0 | 66.4 | 101.0 | 104.0 |
| | | | | | — | — | — | — | 97.5 | 108.0 |
| WD18 | 0.99 | 0.05 | 6 | 35 | 211.3 | 218.1 | 13.7 | 66.8 | 98.2 | 87.4 |
| | | | | | 210.2 | 215.8 | 14.3 | 68.4 | 95.5 | 89.1 |
| WA09-2 | 1.06 | 0.09 | 32 | 82 | 214.6 | 220.2 | 16.1 | 63.0 | 103.7 | 83.2 |
| | | | | | 208.2 | 220.2 | 16.0 | 63.1 | 94.9 | 92.3 |
| WA07-2 | 1.04 | 0.10 | 6 | 41 | 212.9 | 225.9 | 16.2 | 66.3 | 100.1 | 93.3 |
| | | | | | 212.4 | 224.6 | 16.9 | 67.4 | 103.9 | 100.7 |
| WA01-2 | 1.06 | 0.09 | 22 | 10 | 207.6 | 220.0 | 16.9 | 69.4 | 87.1 | 83.8 |
| | | | | | 208.1 | 219.1 | 17.6 | 68.2 | 84.0 | 78.3 |

TABLE 3

Tensile & Impact Properties of 13Cr—8Ni—2Mo Steels
(1" Thick Flat Bar Heat Treated 1700° F. × 1 Hr, AC to <300° F., IWQ + 1050° F. × 4 Hrs, AC to <100° F., IWQ for 30 min.)

| | Chemistry | | | | Tensile | | | | Charpy Impact - ft-lbs | | | |
|---|---|---|---|---|---|---|---|---|---|---|---|---|
| | | | | | | | | | Longitudinal | | Transverse | |
| | | | S | $N_2$ | 0.2% YS | UTS | | | | | | |
| Heat No. | Al % | Ti % | ppm | ppm | Ksi | Ksi | % EI | % RA | RT | −22° F. | RT | −22° F. |
| | | | | | Steels of this invention: | | | | | | | |
| WA06-2 | 1.03 | 0.02 | 6 | 9 | 181 | 188 | 19 | 74 | 146 | 160 | 145 | 144 |
| | | | | | 181 | 188 | 19 | 74 | 173 | 157 | 153 | 139 |
| WA01-1 | 1.06 | 0.02 | 22 | 4 | 184 | 192 | 19 | 73 | 136 | 133 | 136 | 133 |
| | | | | | 184 | 193 | 18 | 74 | 143 | 135 | 127 | — |
| | | | | | Steels not of this invention: | | | | | | | |
| WD13 | 1.04 | 0.01 | 48 | 26 | 182 | 186 | 15 | 67 | 72 | 63 | 55 | 48 |
| | | | | | 184 | 180 | 16 | 68 | 65 | 63 | 55 | 49 |
| WD17 | 1.03 | 0.01 | 6 | 27 | 176 | 180 | 17 | 71 | 104 | 89 | 78 | 55 |
| | | | | | 187 | 190 | 16 | 68 | 91 | 55 | 83 | 76 |
| WD22-1 | 1.02 | 0.01 | 6 | 43 | 185 | 188 | 16 | 71 | 87 | 88 | 73 | 65 |
| | | | | | 176 | 180 | 17 | 72 | 82 | 76 | 75 | 65 |
| WD14 | 1.07 | 0.01 | 10 | 40 | 184 | 188 | 15 | 70 | 86 | 70 | 56 | 54 |
| | | | | | 184 | 187 | 17 | 71 | 80 | 74 | 60 | 51 |
| WD19 | 1.05 | 0.01 | 6 | 72 | 187 | 191 | 16 | 67 | 66 | 52 | 42 | 35 |
| | | | | | 183 | 187 | 17 | 69 | 60 | 47 | 49 | 35 |
| WA09-1 | 1.06 | 0.02 | 33 | 97 | 179 | 186 | 16 | 61 | 41 | 45 | 25 | 27 |
| | | | | | 181 | 189 | 17 | 61 | 47 | 40 | 26 | 23 |
| U.S. Pat. | 1.0 | — | 30 | 18 | 188 | 197 | 14 | 68 | 120 | — | — | — |
| No. 3,556,776 | | | | | 185 | 194 | 15 | 70 | 102 | — | — | — |
| WB19 | 1.04 | 0.03 | 6 | 37 | 185 | 193 | 19 | 72 | 111 | 55 | 109 | 53 |
| | | | | | 183 | 191 | 18 | 73 | 129 | 60 | 109 | 49 |
| WA02 | 1.07 | 0.05 | 20 | 13 | 182 | 188 | 19 | 73 | 160 | 87 | 125 | 54 |
| | | | | | 190 | 197 | 18 | 73 | 164 | 126 | 129 | 62 |
| WA10 | 1.05 | 0.05 | 31 | 57 | 184 | 191 | 18 | 72 | 119 | 64 | 78 | 53 |
| | | | | | 182 | 191 | 19 | 70 | 110 | 72 | 83 | 49 |
| WD15 | 1.06 | 0.05 | 6 | 7 | 195 | 197 | 18.1 | 74.6 | 156 | 116 | 128 | 75 |
| | | | | | 186 | 188 | 18.1 | 74.4 | 168 | 115 | 102 | 58 |
| WD18 | 0.99 | 0.05 | 6 | 35 | 184 | 187 | 18 | 73 | 99 | 79 | 77 | 36 |
| | | | | | 182 | 186 | 17 | 74 | 99 | 64 | 68 | 43 |
| WD16 | 1.02 | 0.09 | 7 | 9 | 200 | 205 | 17 | 74 | 105 | 69 | 95 | 47 |
| | | | | | 199 | 203 | 17 | 74 | 124 | 80 | 96 | 55 |
| WA07-1 | 1.04 | 0.10 | 6 | 41 | 193 | 201 | 17 | 70 | 112 | 73 | — | 46 |
| | | | | | 190 | 197 | 18 | 70 | 115 | 50 | 74 | 45 |
| WA01-2 | 1.06 | 0.09 | 22 | 10 | 191 | 199 | 19 | 72 | 122 | 63 | 101 | 39 |
| | | | | | 195 | 204 | 18 | 71 | 81 | 53 | 65 | 30 |
| WA09-2 | 1.06 | 0.09 | 32 | 82 | 197 | 203 | 17 | 66 | 65 | 30 | 49 | 30 |
| | | | | | 190 | 198 | 17 | 68 | 48 | 30 | 75 | 22 |

That which is claimed is:

1. A stainless steel consisting essentially of about 12.25% to 13.25% chromium, about 7.5% to 8.5% nickel, about 2.0% to 2.5% molybdenum, about 0.8% to 1.35% aluminum, not exceeding 0.05% carbon, not exceeding 0.10 silicon, not exceeding 0.10% manganese, not exceeding 0.10% phosphorus, not exceeding 0.0025% sulfur, not exceeding 0.0020% nitrogen, and remainder essentially iron, and wherein the combined amount of sulfur plus nitrogen does not exceed 0.0030%.

2. A stainless steel according to claim 1, in which titanium, if present, is less than 0.05%.

3. A stainless steel according to claim 1, having a fracture toughness at yield strength levels below 200 ksi of greater than 200 ksi-in$^{1/2}$.

4. A stainless steel according to claim 1, having a yield strength of 200 ksi or greater and wherein the combined amount of sulfur plus nitrogen does not exceed 0.00260.

5. A stainless steel according to claim 1, wherein the combined amount of sulfur plus nitrogen does not exceed 0.0020% and the titanium level does not exceed 0.02%.

6. A stainless steel consisting essentially of about 12.25% to 13.25% chromium, about 7.5% to 8.5% nickel, about 2.0% to 2.5% molybdenum, about 0.8% to 1.35% aluminum, not exceeding 0.05% carbon, not exceeding 0.10 silicon, not exceeding 0.10% manganese, not exceeding 0.10% phosphorus, not exceeding 0.0025% sulfur, not exceeding 0.0020% nitrogen, not exceeding 0.02% titanium and remainder essentially iron, and wherein the combined amount of sulfur plus nitrogen does not exceed 0.0020%.

7. A stainless steel which consists essentially of an iron base with 12.25% to 13.25% chromium, 7.5% to 8.5% nickel, 2.0% to 2.5% molybdenum, 0.8% to 1.35% aluminum, not exceeding 0.05% carbon, not exceeding 0.10% silicon, not exceeding 0.10% manganese, not exceeding 0.10% phosphorus, not exceeding 0.0025% sulfur, not exceeding 0.0020% nitrogen, and not exceeding 0.04% titanium.

8. A heated treated precipitation hardened article of stainless steel which consists essentially of an iron base with 12.25% to 13.25% chromium, 7.5% to 8.5% nickel, 2.0% to 2.5% molybdenum, 0.8% to 1.35% aluminum, not exceeding 0.05% carbon, not exceeding 0.10% silicon, not exceeding 0.10% manganese, not exceeding 0.10% phosphorus, not exceeding 0.0025% sulfur, not exceeding 0.0020% nitrogen, and not exceeding 0.04% titanium and having a fracture toughness at yield strength levels below 200 ksi of greater than 200 ksi-in$^{1/2}$.

9. A method for improving the fracture toughness of stainless steels which have an iron base with 12.25% to 13.25% chromium, 7.5% to 8.5% nickel, 2.0% to 2.5% molybdenum, and 0.8% to 1.35% aluminum, said method comprising melting selected raw materials under controlled conditions to achieve in the stainless steel a sulfur content not exceeding 0.0025%, a nitrogen content not exceeding 0.0020%, a titanium content of less than 0.05%, and a combined amount of sulfur plus nitrogen not exceeding 0.0030%.

10. A method according to claim 9, wherein said step of melting selected raw materials under controlled conditions comprises melting raw materials having low nitrogen content under vacuum conditions.

11. A method according to claim 10, wherein said step of melting selected raw materials under controlled conditions comprises vacuum induction melting and vacuum arc remelting.

12. A method for producing a stainless steel article of high fracture toughness, said method comprising forming a stainless steel which consists essentially of an iron base with 12.25% to 13.25% chromium, 7.5% to 8.5% nickel, 2.0% to 2.5% molybdenum, 0.8% to 1.35% aluminum, not exceeding 0.05% carbon, not exceeding 0.10% silicon, not exceeding 0.10% manganese, not exceeding 0.10% phosphorus, not exceeding 0.0025% sulfur, not exceeding 0.0020% nitrogen, and not exceeding 0.04% titanium; and heat treating the stainless steel to produce a precipitation hardened stainless steel article having a fracture toughness at yield strength levels below 200 ksi of greater than 200 ksi-in$^{1/2}$.

* * * * *

UNITED STATES PATENT AND TRADEMARK OFFICE

CERTIFICATE OF CORRECTION

PATENT NO. : 5,888,449

DATED : March 30, 1999

INVENTOR(S) : Kennedy et al.

It is certified that error appears in the above-identified patent and that said Letters Patent is hereby corrected as shown below:

Column 7, line 62, "0.00260" should read --0.0026%--.

Signed and Sealed this

Twenty-seventh Day of July, 1999

*Attest:*

Q. TODD DICKINSON

*Attesting Officer*

*Acting Commissioner of Patents and Trademarks*